US005716255A

United States Patent [19]

Abercrombie et al.

[11] Patent Number: 5,716,255

[45] Date of Patent: Feb. 10, 1998

[54] BRASSIERE UNDERLINER FOR ABSORPTION OF PERSPIRATION

[76] Inventors: Sylvia A. Abercrombie, 14567 Trenton Rd., Southgate, Mich. 48195; Lilly L. Maness, 14962 Monroe, Flat Rock, Mich. 48134

[21] Appl. No.: 615,618

[22] Filed: Mar. 13, 1996

[51] Int. Cl.[6] ..... A41C 3/12; A41D 27/04; A41D 27/12

[52] U.S. Cl. ..... 450/60; 450/57; 450/81; 2/73; 2/267; 2/463

[58] Field of Search ..... 2/73, 267, 268, 2/53, 56, 57, 1, 455, 463; 450/53, 56, 57, 60, 61, 62, 80, 81, 86

[56] References Cited

U.S. PATENT DOCUMENTS

| | | | |
|---|---|---|---|
| 1,078,443 | 11/1913 | Just | 2/53 |
| 2,258,277 | 10/1941 | Bullinger | 450/53 |
| 2,505,720 | 4/1950 | Peiser et al. | 450/56 |
| 3,164,155 | 1/1965 | Simonsen | 450/62 |
| 3,402,719 | 9/1968 | Simonsen | 450/60 |
| 3,419,895 | 12/1968 | Stephensen | 450/60 |
| 3,642,009 | 2/1972 | Nobbs | 450/60 |
| 3,890,978 | 6/1975 | Nobbs | 450/60 |
| 3,952,752 | 4/1976 | Huttle, Jr. | 450/60 X |
| 4,747,162 | 5/1988 | Yanagihara | 2/56 X |
| 5,326,305 | 7/1994 | Fochler | 450/57 |
| 5,385,502 | 1/1995 | Moretz et al. | 450/93 |

*Primary Examiner*—Jeanette E. Chapman
*Attorney, Agent, or Firm*—James M. Deimen

[57] ABSTRACT

A brassiere underliner fittable to a brassiere to allow absorption of perspiration of the user. No modification of the brassiere is needed. The brassiere underliner fits under the breasts of the brassiere user and has greater thickness and rises higher in between the breasts to capture a greater amount of perspiration between the breasts. The underliner has curvatures that are contoured to fit the curves of the undersides of the breasts. A tacky adhesive retains the underliner in position on the brassiere. The underliner can be disposable, thereby allowing quick replacement as necessary and avoiding potential embarrassment. Further, the use of the underliner limits soiling of the brassiere, hence extending the life of the expensive garment.

17 Claims, 2 Drawing Sheets

BRASSIERE UNDERLINER FOR ABSORPTION OF PERSPIRATION

BACKGROUND OF THE INVENTION

The field of the invention pertains to brassieres. In particular, the invention pertains to an underliner to absorb perspiration and to prevent rashes and irritation between and under the breasts.

It is known to modify brassieres by inserting an absorbent layer between the fabric layers of the cup of a brassier, U.S. Pat. No. 5,269,720. In addition to the absorbent layer between fabric layers of the cup, an additional absorbent layer can be added between fabric layers of a brassiere, U.S. Pat. No. 5,385,502.

Separate layers for support are known in brassiere construction from U.S. Pat. No. 3,890,978 and U.K. specification 443,858. It is also known to include a mesh insert along the inner edges of a brassiere to permit free flow of air during normal athletic use and thereby prevent the build up of moisture.

U.S. Pat. No. 4,747,162 and U.S. Pat. No. 4,541,129 disclose a disposable perspiration absorbing pad shaped for use in an underarm area and a sweat absorbent undershirt, respectively.

The above brassiere configurations are generally intended to absorb the sweat within the brassieres themselves, but these brassieres require special construction to achieve the desired absorption. The other above devices absorb sweat under the armpits or on the upper torso. With a view to improve user comfort and convenience and to avoid certain problems with the above brassiere constructions, the brassiere underliner described below seeks to remedy the problems.

SUMMARY OF THE INVENTION

The invention comprises a brassiere underliner that can be disposable or alternatively, if the underliner is washable or cleanable, can be separately washed or cleaned and reused in contrast to the prior modified brassieres. During a period of exercise, particularly on a hot, humid day, a woman may perspire greatly. For a woman with large breasts, the perspiration between and under her breasts can be uncomfortable. It is common knowledge that perspiration under these conditions can cause irritation and rashes to occur. Less well known, such perspiration can also be a problem under stressful situations and for some individuals a common everyday problem.

The new brassiere underliner uses an absorbent material to absorb the perspiration. The underliner, being removable, can be removed and either discarded or washed or cleaned for reuse. The use of the underliner allows for perspiration by the user without overly soiling the brassiere. As brassieres can be expensive, the life and the freshness of the brassiere is therefore extended. Moreover, with the new underliner, the brassiere is not required to be modified in any manner. Any properly fitting brassiere may be used with the new underliner.

DESCRIPTION OF THE PREFERRED EMBODIMENT

Figure 1:
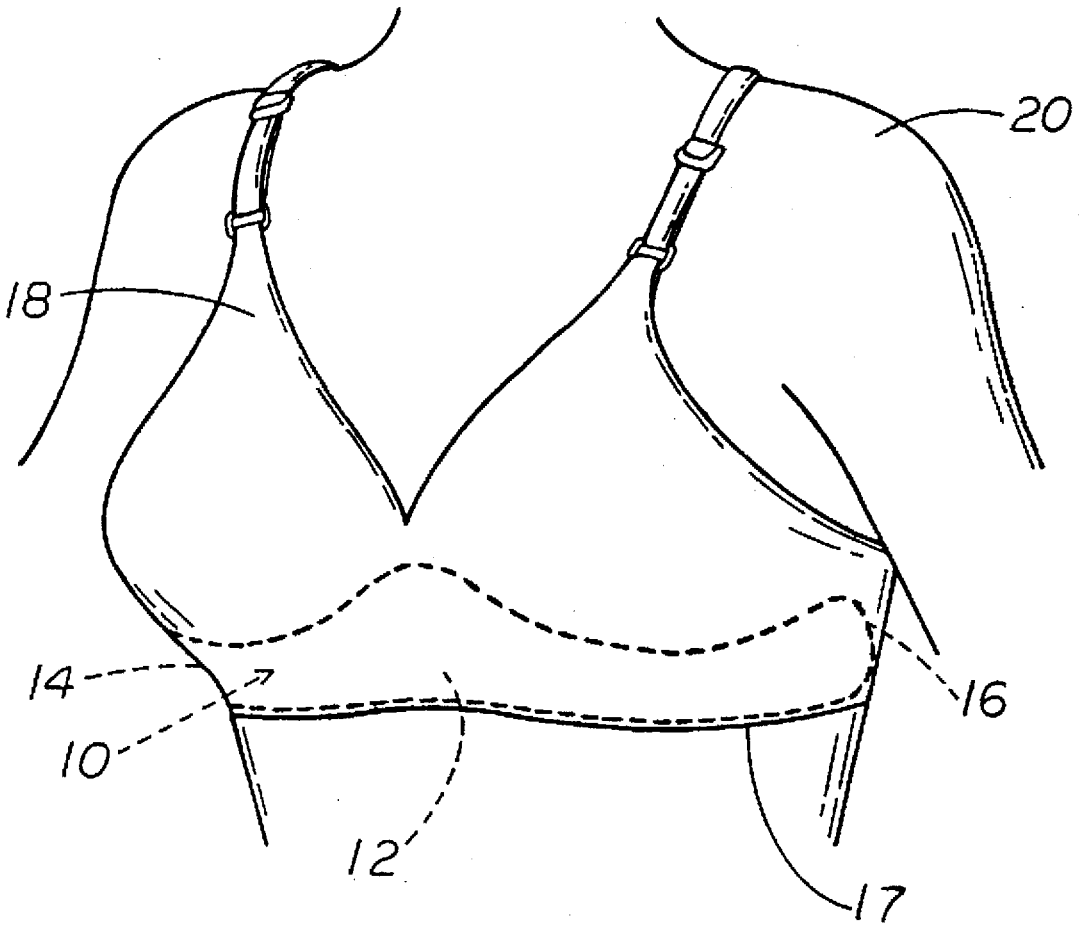
FIG. 1 illustrates a perspective view of the brassiere underliner according to the invention.

In FIG. 1, a brassiere underliner generally denoted as 10 is shown in perspective view as used. The brassiere underliner 10 comprises a body 12 having a first end 14 and a second end 16. The body 12 is fittable to an inner lower edge circumferential band 17 of a brassiere 18. The brassiere 18 in this instance is shown being worn on the upper torso of a user 20 (shown in phantom in FIG. 1).

Figure 2:
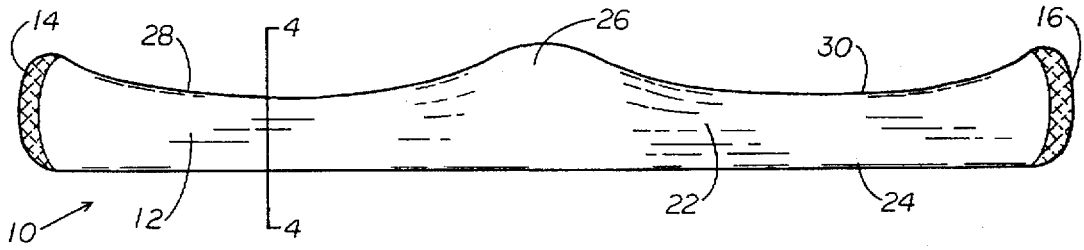
FIG. 2 illustrates a front view of the brassiere underliner.

As best shown in FIG. 2, the body 12 of the brassiere underliner 10 has an elongated shape 22 with a laterally extending lower edge 24. The ends 14 and 16 of the body and a central portion 26 of the body 12 extend higher from the lower edge 24. Curvatures 28 and 30 are formed on either side of the central portion 26. The curvatures 28 and 30 generally follow the curves of the undersides of the breasts of the user.

Figure 3:
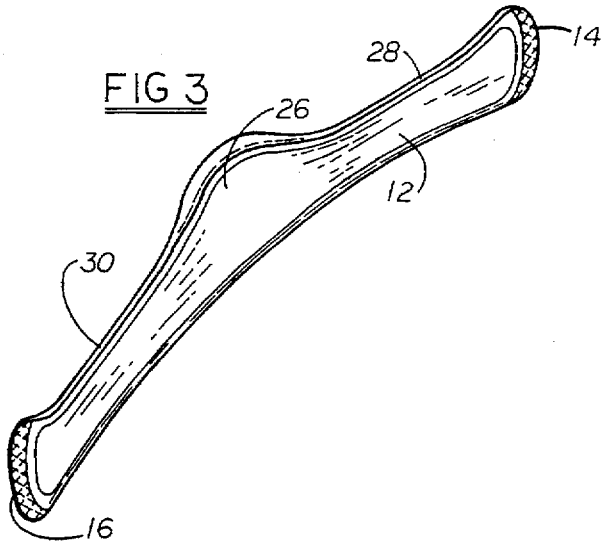
FIG. 3 illustrates a perspective back view of the brassiere underliner.

Referring now to FIG. 3, the central portion 26 of the body 12 has a greater thickness of material than the portions below the curvatures 28, 30 and the ends 14, 16. This allows the underliner 10 to be capable of more absorption in the area between the user's breasts.

Figure 4:
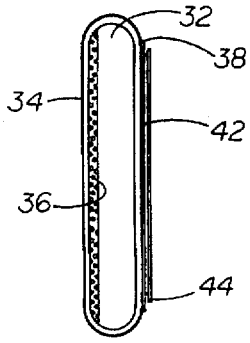
FIG. 4 illustrates a sectional view of the brassiere underliner.

FIG. 4 shows a sectional view through the body 12 of the brassiere underliner 10. Several layers of materials are evident in the body 12. An inner layer 32 of material can be formed from absorbent materials such as cellulose or other absorbent material such as used for disposable diapers and panty liners. The material is of sufficient absorbency, density and thickness to allow for perspiration to be absorbed from the body of the user over an extended period of outdoor or indoor physical activity.

The material layer 34 that touches the user's skin is non-irritating/non-allergic and is compatible with wet skin. The material layer 34 is soft yet porous for transmissibility of the perspiration to the inner material 32. Desiccants can be used in the inner layer 32 to draw the moisture away from the user's skin and to retain the moisture in the absorbing inner material 32. Perspiration odor neutralizers 36 (deodorizers, baking soda) and scents can also be added to the underliner 10 layers as the separate layer shown or as a part of the inner material 32.

A barrier material layer 38 is placed adjacent to the material layer 34 and outside the absorbing material 32 to prevent the perspiration from passing completely through the underliner 10 and into the brassiere 18 or undergarment and possibly into the exterior clothing. Additional interior layers 32 of absorbent or deodorizing materials can be effectively utilized herein.

Means for attaching 40 the underliner 10 to the brassiere 18 are provided on the outside of the barrier material layer 38. The attaching means 40 can be a tacky adhesive 42, a double sided tape, or other types of attachments. A removable cover 44 protects the attaching means 40 until the use thereof is desired. To allow use, the cover 44 is removed and the means for attaching 40 to hold the underliner 10 are secured to the brassiere 18 in the desired position.

A brassiere underliner 10 that is reusable can be formed from washable or cleanable materials. As an option accessing means may be provided into the inner layer 32. The accessing means facilitates the emplacement of deodorizers such as baking powder into the underliner to promote the odor controlling properties of the underline. For example a hook and loop fastener can be used as the means for accessing the inner layer 32.

The brassiere underliner 10 can be circumferential around the torso or extend part way under the breasts and to the sides of the torso. Accordingly, the underliner 10 can be sized to the traditional brassiere measurements around the torso. The sizes of the underliner 10 can be small, medium, large and extra large to accommodate various body shapes and sizes.

It is envisioned that the underliners be purchased at retail outlets and also that disposable underliners be rended at various venues. Sporting venues particularly come to mind such as golf courses, tennis clubs, soccer arenas and softball facilities. However, wherever hot, humid uncomfortable environments exist, such as in a non-air-conditioned factory, the comfort of the user can be improved with the wearing of the underliner 10

In use, the cover 44 of the underliner 10 is removed, thus exposing the adhesive or other attaching means 40. The attaching means 40 of the underliner 10 are turned to face and then are attached to the inner lower band 17 of the brassiere 18 which in turn fits around the torso of the user 20. The underliner 10 is firmly pressed against the lower band 17 and then the user 20 can finish emplacement of the brassiere 18 on the user's body. If the brassiere 18 is of a front closing type, the attaching means 40 of the brassiere underliner 10 are attached to one side of the brassiere inner band 17, then the brassiere 18 is emplaced on the body and the underliner 10 is adjusted to comfortably fit against the inner band 17 of the brassiere and the rest of the attaching means 40 are employed to retain the underliner in the desired position.

Consequently, by use of the brassiere underliner 10, a user's comfort is increased, particularly in hot, humid conditions.

We claim:

1. A device fittable to a brassiere, the brassiere for supporting the breasts of a user, the device comprising a body having at least one laterally extending edge, at least two ends and a central portion, the central portion extending from the laterally extending edge at least as much as the two ends, the central portion being of a greater thickness than the rest of the body, the central portion of the device being placeable between the breasts when the device is worn, the body including the central portion comprising moisture absorbing material, and means for attaching the device temporarily to a conventional brassiere.

2. The device according to claim 1 wherein the device is multilayered and disposable.

3. The device according to claim 1 further comprising curvatures separating the two ends and the central portion.

4. The device according to claim 3 wherein the curvatures generally follow the curves under the breasts of the user.

5. The device according to claim 1 wherein the two ends and the central portion extend farther from the laterally extending edge than the curvatures.

6. The device according to claim 1 wherein the central portion has a greater thickness of absorbent material than the rest of the body.

7. The device according to claim 1 wherein the absorbing material is partially covered by a moisture barrier material and partially covered by a perspiration transmissive material.

8. The device according to claim 7 wherein the perspiration transmissive material comprises a material compatible in direct contact with wet skin.

9. The device according to claim 1 wherein the attaching means comprises an adhesive.

10. The device according to claim 9 further comprising a removable cover for covering the attaching means.

11. The device according to claim 1 further comprising an odor controller therein.

12. The device according to claim 11 wherein the odor controller comprises baking soda.

13. The device according to claim 1 further comprising scent added thereto.

14. An item for comfort of the user comprising in combination a brassiere having a circumferential band, and a disposable underliner removably fitted to the brassiere, said disposable underliner comprising a body having at least one laterally extending edge, at least two ends and a central portion, the central portion extending from the laterally extending edge at least as much as the two ends, the central portion of the device being placeable between the breasts when the device is worn, and the central portion being of a greater thickness than the rest of the body.

15. The item according to claim 14 wherein the disposable underliner is removably fitted adjacent the circumferential band.

16. The item according to claim 14 wherein the disposable underliner is removably attached to the circumferential band.

17. A method of using the brassiere underliner according to claim 1 comprising aligning the means for attaching with a brassiere, and affixing the means for attaching to the brassiere.

* * * * *